US006290519B1

(12) United States Patent
Lee

(10) Patent No.: US 6,290,519 B1
(45) Date of Patent: Sep. 18, 2001

(54) EJECTOR FOR USE WITH A CARD EDGE CONNECTOR

(75) Inventor: George Lee, Taipei (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/751,541

(22) Filed: Dec. 28, 2000

(51) Int. Cl.[7] ..... H01R 13/62
(52) U.S. Cl. ..... 439/157
(58) Field of Search ..... 439/157, 159, 439/160

(56) References Cited

U.S. PATENT DOCUMENTS 5,672,069 * 9/1997 Cheng et al. ..... 439/160
5,676,555 * 10/1997 Yu et al. ..... 439/157
5,730,611 * 3/1998 Cheng et al. ..... 439/160
5,957,708 * 9/1999 Lin ..... 439/157
5,980,282 * 11/1999 Vheng ..... 439/157
6,039,595 * 3/2000 Tseng et al. ..... 439/377
6,113,404 * 9/2000 Choy ..... 439/160

* cited by examiner

*Primary Examiner*—Tulsidas Patel
(74) *Attorney, Agent, or Firm*—Wei Te Chung

(57) ABSTRACT

A card edge connector (20) comprises an insulative housing (22) with a plurality of conductive contacts (26) for electrically and mechanically engaging with an inserted memory module (60). A pair of towers (30) are formed on opposite ends of the housing and each defines a cavity (32) for insertion of an eject member (40) therein. The eject member is adapted to rotate in the tower, alternately locking and ejecting the memory module out of the housing at its upright and fully slanted position, respectively. The eject member forms a stopping device (50) for abutting against an outer end wall (36) of the housing during ejection of the memory module, thereby helping to prevent the eject member from over-rotating, and protecting the eject member and the housing from being damaged by an unusually large operating force applied by a user against the eject member.

8 Claims, 6 Drawing Sheets

EJECTOR FOR USE WITH A CARD EDGE CONNECTOR

BACKGROUND OF THE INVENTION

1. Field of the Invention

The present invention relates to an ejector for use with a card edge connector, and particularly to an ejector which is adapted to be assembled to the housing of the connector, and which includes a stopping device to protect the ejector from damage caused by an unusually large operating force applied by a user.

2. Description of Prior Art

With the development of communication and computer technology, Dual In-line Memory Module (DIMM) cards have become more and more popular for use in the PC industry, and thus DIMM socket connectors mounted on mother boards for mechanically and electrically connecting to DIMM cards are required. U.S. Pat. Nos. 5,074,800, 5,167,517, 5,211,568, 5,302,133 and 5,364,282 disclose typical DIMM connectors. These can be compared with conventional card edge connectors, as featured in U.S. Pat. No. 4,846,734. DIMM connectors typically include a pair of latch/eject members at two opposite ends thereof to latchably retain a DIMM card. These latches not only prevent inadvertent ejection of the inserted card due to vibration or external impact, but also allow easy ejection of DIMM cards by a rotational movement of the latch/eject member.

Referring to FIG. 6, U.S. Pat. No. 5,634,803, which was granted to the same assignee on Jun. 3, 1997, discloses such a DIMM connector 10. The DIMM connector 10 comprises an elongate housing 12 mounted on a mother board (not shown) and a plurality of conductive contacts 16 retained in the housing 12. An inserted card (not shown) is adapted for insertion into a central slot 14 defined in the housing 12 to make an electrical and mechanical connection with the conductive contacts 16 for signal transmission. A pair of latch/eject members 70 (only one shown) are rotatably engaged with opposite ends of the housing and alternately lock an inserted card in the housing 12 or eject the inserted card from the housing 12. An engaging block 40 is formed on both ends of a pair of elongated walls of the housing 12, each forming a slanted surface 42 thereon. The latch/eject member 70 includes an eject portion 78 for abutting against the slanted surface 42 of the engaging block 40. Using this engagement, the inserted card is ejected out of the housing 12 and the latch/eject member 70 is prevented from over-rotation during ejection of the inserted card. The engaging block 40 and the eject portion 78 must both be strong enough to withstand an engaging force therebetween caused by an operating force pressing against the lever portion 82 of the latch/eject member 70. Accordingly, if a user presses against the lever portion 82 with too large an operating force, the engaging force will be too large, causing damage to the engaging block 40 and the eject portion 78 since they are relatively thin and fragile.

Hence, an improved ejector for use with such a card edge connector is required to overcome the disadvantages of the prior art.

BRIEF SUMMARY OF THE INVENTION

A main object of the present invention is to provide an eject member for use with a card edge connector wherein the eject member provides a stopping device for preventing damage to the eject member caused by an unusually large operating force applied by a user during ejection of a memory module from the card edge connector.

To fulfill the above-mentioned object, a card edge connector, for use with a memory module, in accordance with the present invention comprises an elongated, insulative housing defining a central slot for insertion of the memory module and a plurality of conductive contacts. The conductive contacts are retained in opposite elongated walls of the housing and extend into the central slot for electrically and mechanically engaging with the memory module. The insulative housing forms at least one tower at one end thereof which includes a pair of side walls and an outer end wall defining a cavity therebetween. Additionally, an engaging block defines an inward side of the cavity opposite to the outer end wall of the tower. An eject member is adapted for insertion into the cavity of the tower for latching with the memory module and for ejecting the memory module from the housing. The eject member includes a main body with an eject portion and a lock portion extending respectively from lower and upper ends of the main body. The eject portion is adapted for engaging with the engaging block at the limit of its inward rotation during ejection of the memory module from the card edge connector. A stopping device is integrally formed on the main body for abutting against an outer surface of the end wall of the housing, preventing the eject member from over-rotating during the ejection of the memory module from the card edge connector and preventing the eject portion and engaging block from being damaged.

Other objects, advantages and novel features of the invention will become more apparent from the following detailed description of the present embodiment when taken in conjunction with the accompanying drawings.

DETAILED DESCRIPTION OF THE INVENTION

Figure 1:
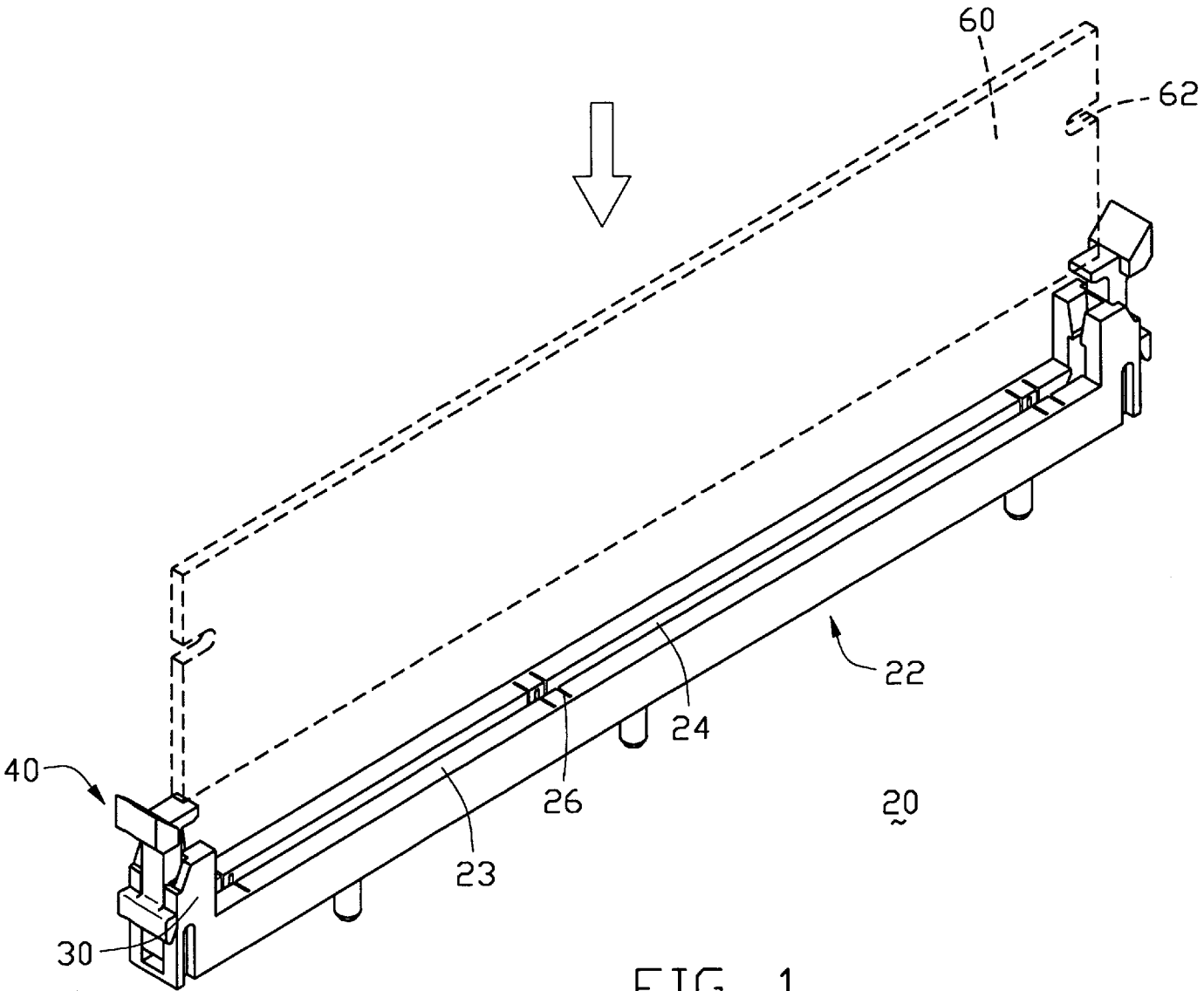
FIG. 1 is a perspective view of a card edge connector of the present invention before a memory module shown by dotted lines is engaged therewith.

Referring to FIG. 1, a card edge connector 20, i.e. a DIMM connector, in accordance with the present invention comprises an elongated insulative housing 22 with two rows of conductive contacts 26 positioned in two elongated walls 23 of the housing 22, and a pair of eject members 40 rotatably mounted at two opposite ends of the housing 22. The housing 22 is substantially similar to the housing 12 of the U.S. Pat. No. 5,634,803, having the same assignee as the present invention, which is incorporated herein by reference. The housing 22 defines a central slot 24 extending along its lengthwise direction for insertion of a memory module 60 therein. The conductive contacts 26 extend into the central slot 24 for electrically and mechanically engaging with the memory module 60.

Figure 2:
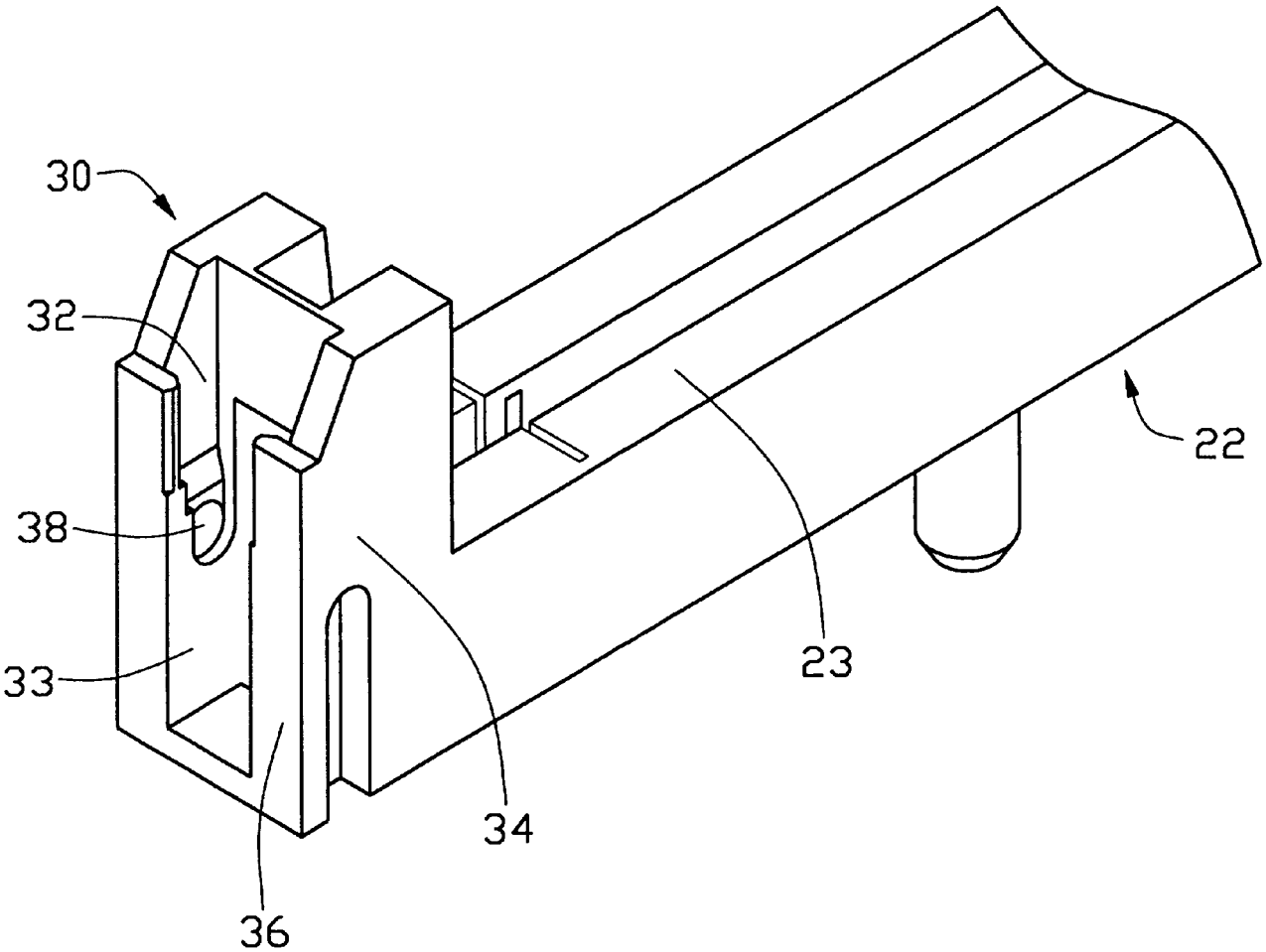
FIG. 2 is a partial enlarged perspective view of an insulative housing of the card edge connector of FIG. 1.

Referring to FIG. 2, a pair of towers 30 are integrally formed on two opposite ends of the housing 22 and each defines a cavity 32 communicating with the central slot 24 for receiving a corresponding eject member 40 (see FIG. 2) therein. Each tower 30 comprises a pair of side walls 34 defining a pair of through holes 38, and an outer end wall 36 defining an outward boundary of the cavity 32. The end wall 36 defines an opening 33 communicating with the cavity 32 for entrance of the eject member 40. A pair of tapered engaging blocks 39 (only one shown in FIG. 5) are respectively formed on two inner surfaces of the elongated walls 23 adjacent each cavity 32 and defining an inward boundary of the cavity 32. Each engaging block 39 forms a slanted surface 392 extending obliquely downward at a predetermined angle.

Figure 3:
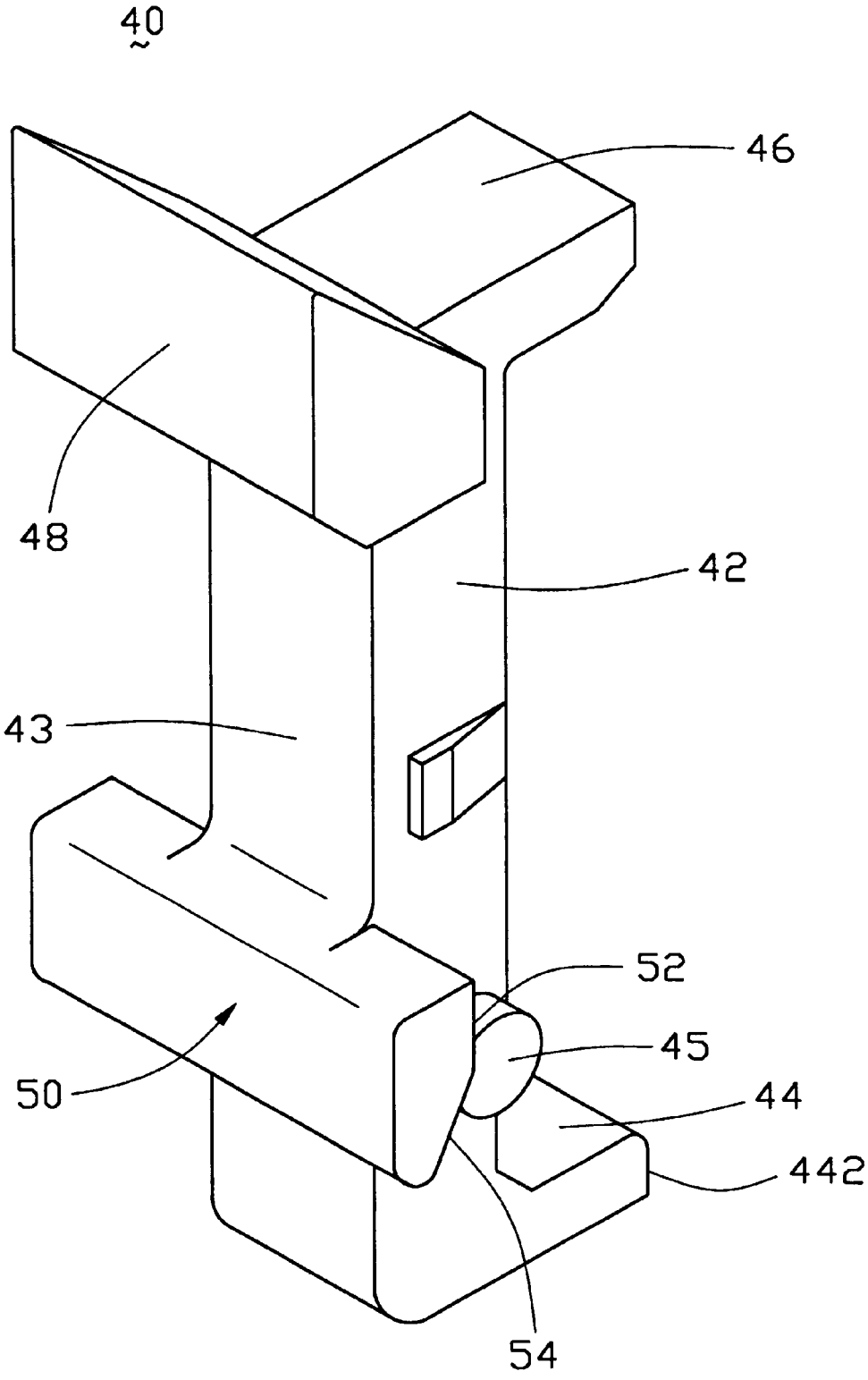
FIG. 3 is a partial enlarged perspective view of an eject member of the card edge connector of FIG. 1.

Referring to FIG. 3, each eject member 40 includes a main body 42 having lock and eject portions 46, 44 both horizontally extending from upper and lower ends thereof, respectively. The lock portion 46 is adapted for locking with a corresponding recess 62 defined in the memory module 60 which is inserted and received within the central slot 24 of the housing 22. A lever portion 48 extends obliquely upward from the upper end of the main body 42 opposite to the lock portion 46 for accepting an operating force applied by the user thereagainst during ejection of the memory module 60 from the housing 22. A pair of spindles 45 are formed on opposite sides of the main body 42 for rotatable insertion into the through holes 38 of the tower 30. The eject portion 44 has a front end surface 442 adapted for rotating upward and engaging with the engaging block 39 when the eject member 40 is rotated about the spindles 45, thereby ejecting the memory module 60 out of the housing 22.

Additionally, a stopping device 50 integrally extends from an outer surface 43 of the main body 42 from a location adjacent to the pair of spindles 45. The stopping device 50 forms a pair of upright surfaces 52 adjacent opposite sides of the main body 42 and a slanted surface 54 obliquely extending downward and outward from the upright surfaces 52 at the predetermined angle defined by the slanted surface 392 of the engaging block 39 in the housing 22.

Figure 4:
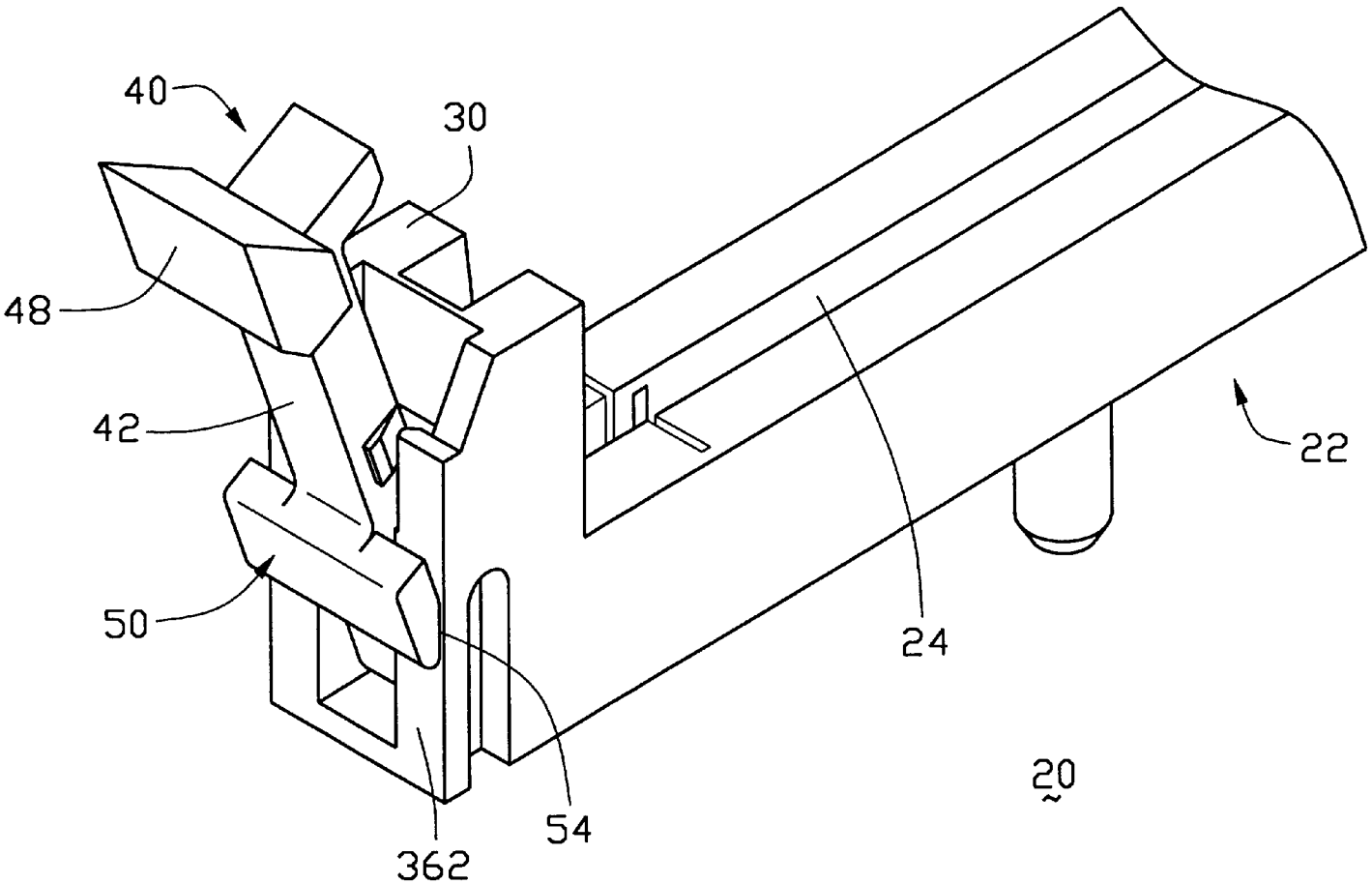
FIG. 4 is a partial enlarged perspective view of the card edge connector of FIG. 1.
Figure 5:
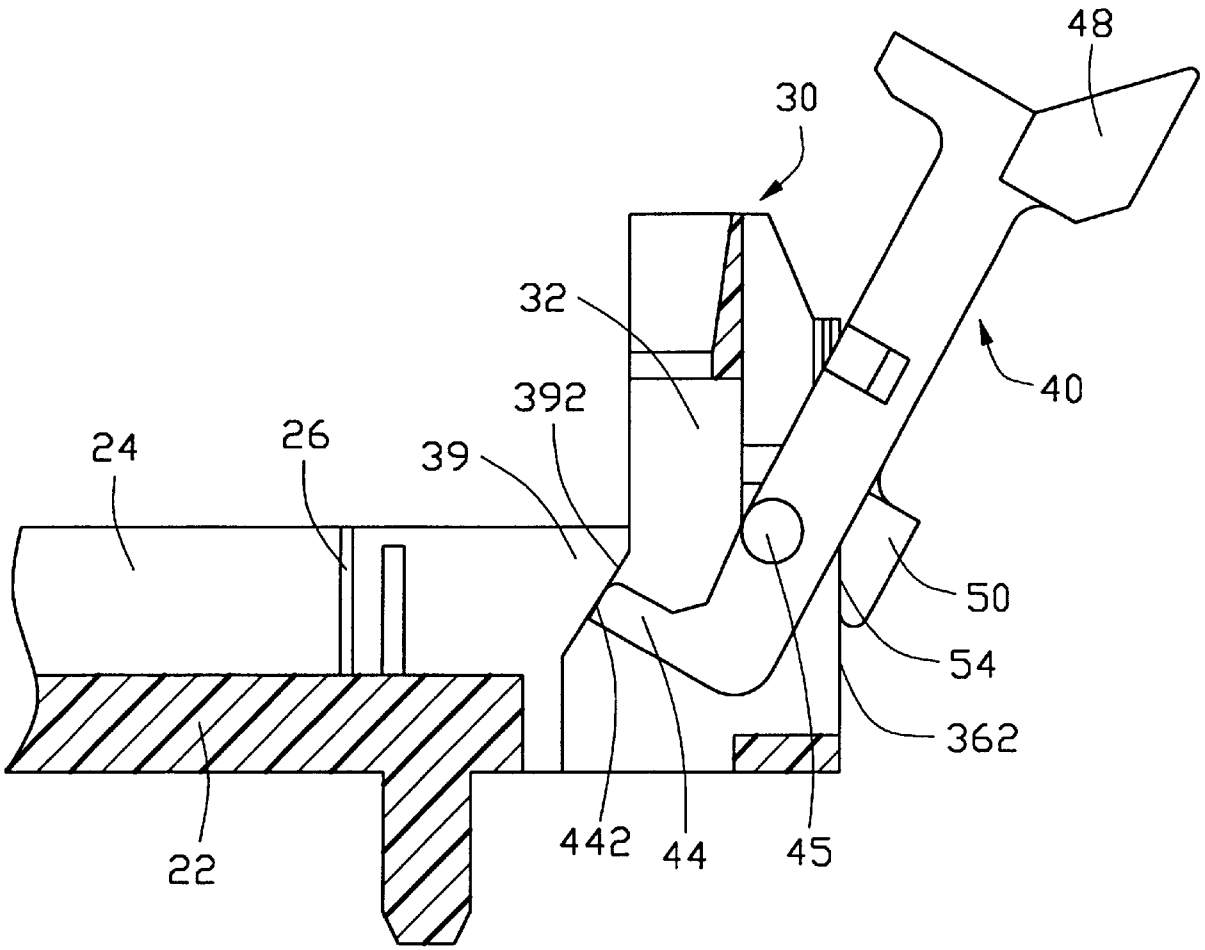
FIG. 5 is a partial cross-sectional view of FIG. 4.
Figure 6:
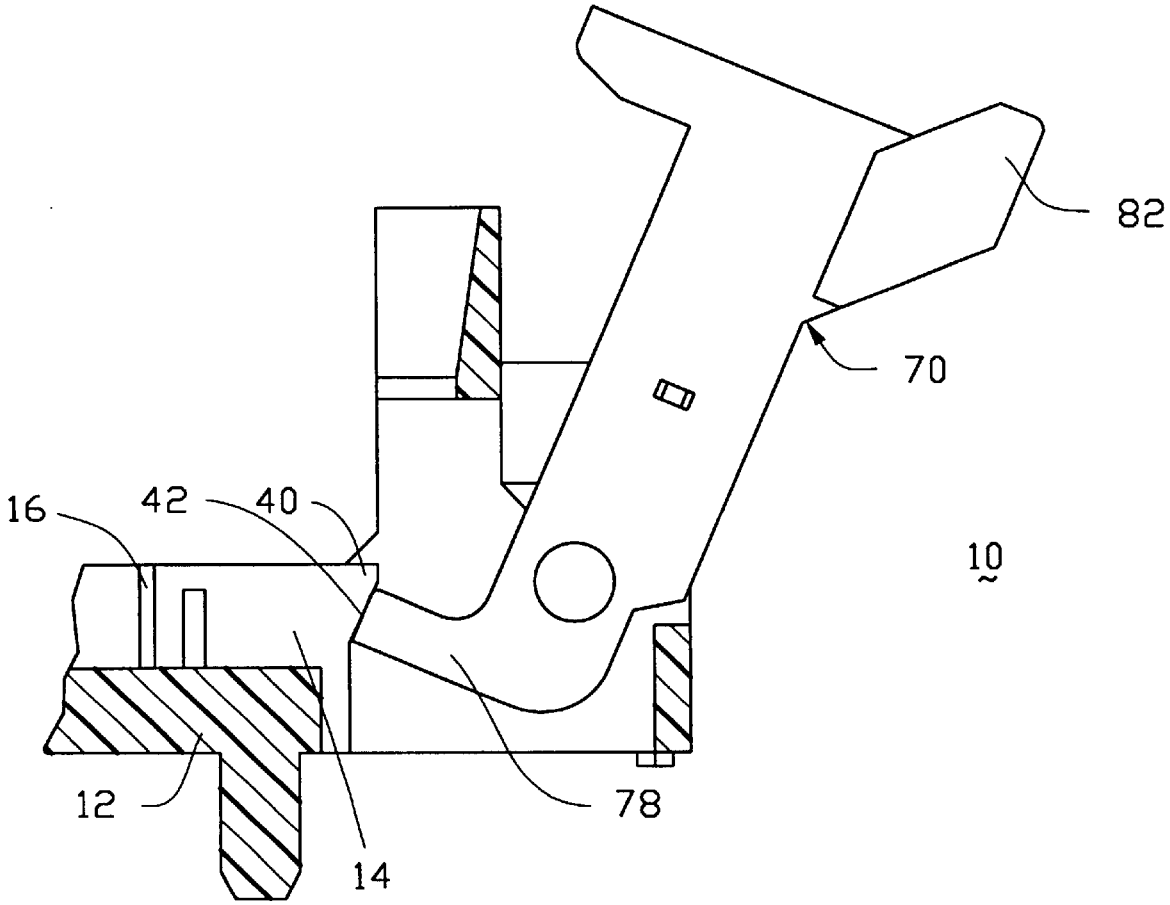
FIG. 6 (PRIOR ART)
FIG. 6 is a cross-sectional view of a prior art card edge connector.

In assembly, referring to FIGS. 1, 4 and 5, each eject member 40 is inserted downward into the opening 33 of a corresponding tower 30 with the eject member 40 being held at an oblique angle. The eject member 40 is pressed downward until the spindles 45 are rotatably received into the corresponding through holes 38 of the tower 30.

In use, the memory module 60 is inserted into the central slot 24 of the housing 22 so as to make an electrical and mechanical connection with the conductive contacts 26 for signal transmission therebetween. At the same time, the eject members 40 are rotated to a first position at which the lock portions 46 of the eject members 40 are locked with corresponding recesses 62 of the memory module 60 for retaining the memory module 60 in the housing 22. In this first position, the upright surfaces 52 abut against corresponding outer surfaces 362 of the end walls 36, protecting the eject member 40 and the housing 22 from being damaged by over-rotation of the eject members 40. When the memory module 60 is to be ejected out of the housing 22, an operating force is exerted against the lever portions 48 of the eject members 40 which rotates the eject members 40 outward to a second position, the eject members 40 pivoting about the axis defined by the spindles 45 until the slanted surfaces 54 of the stopping devices 50 abut against a corresponding outer surfaces 362 of the end walls 36. At the same time, each eject portion 44 is raised until the front end surface 442 thereof abuts against the slanted surface 392 of the corresponding engaging block 39, thereby ejecting the memory module 60 out of the central slot 24 of the housing 22. The engagement between the stopping device 50 and the outer end wall 36 of the housing 22 at this second position not only prevents the eject member 40 from over-rotation in connect with the eject portion 44 and the engaging block 39, but also protects the eject portion 44 and the engaging block 39 from being damaged due to an unusually large operating force applied by the user against the lever portion 48.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for use with a daughter card, comprising:

an elongated, insulative housing having a plurality of conductive contacts fixed therein for electrically and mechanically engaging with said daughter card inserted in the housing, at least one tower integrally formed on one end of said housing, said tower defining a cavity and comprising an end wall defining an outward boundary of the cavity; and an eject member being rotatably engaged with the cavity of the tower for locking the daughter card in the housing in a first position and for ejecting the daughter card out of the housing in a second position, said eject member including a main body and a stopping device projecting from said main body for engaging with the end wall of the housing when the eject member is at the first and second positions, thereby preventing the eject member from over-rotating beyond the first and second positions and protecting the eject member and the housing from damage.

2. The electrical connector as claimed in claim 1, wherein said stopping device extends from an outer surface of the main body of the eject member.

3. The electrical connector as claimed in claim 2, wherein the stopping device forms an upright surface abutting against an outer surface of the end wall of the housing when the daughter card is coupled to the housing and the eject member is at the first position.

4. The electrical connector as claimed in claim 3, wherein the stopping device forms a slanted surface adjacent to the upright surface for abutting against the outer surface of the end wall during ejection of the daughter card from the housing when the eject member is at the second position.

5. The electrical connector assembly as claimed in claim 4, wherein the main body of the eject member forms an eject portion extending perpendicularly from a lower end thereof for abutting against a slanted surface of an engaging block defining an inward boundary of the cavity of the housing for ejecting the daughter card from the housing when the slanted surface of the stopping device abuts against the outer surface of the end wall of the housing.

6. The electrical connector assembly as claimed in claim 5, wherein a lock portion extends perpendicularly from an upper end opposite to the lower end of the main body for locking in a corresponding recess defined in the daughter card, and a lever portion extends obliquely upwardly from the upper end of the main body opposite to the lock portion for a user to exerting an operating force thereagainst.

7. The electrical connector assembly as claimed in claim 1, wherein the main body forms a pair of spindles at opposite sides thereof and adjacent to the stopping device for insertion into two through holes defined in a pair of side walls of the tower.

8. An electrical connector for use with a memory module, comprising:

an elongated, insulative housing forming a pair of opposite elongate walls, the elongate walls defining a central slot therebetween for insertion of the memory module therein, the insulative housing further forming at least one tower at one end thereof, said tower having a pair of elongate walls and an outer end wall defining a cavity therebetween, an engaging block defining an inward boundary of the cavity and opposite the outer end wall;

a plurality of conductive contacts being retained in opposite elongate walls of the housing and extending into the central slot for electrically and mechanically engaging with the memory module; and an eject member being rotatably engaged in the cavity of the tower for latching the memory module in a first position and for ejecting the memory module from the housing in a second position, said eject member having a main body, an eject portion extending from a lower end of the main body for engaging with the engaging block of the housing at the second position for ejecting the memory module from the housing, the main body further forming a stopping device abutting against an outer surface of the end wall of the housing when the eject portion is at the second position for preventing the eject member from over-rotating and for protecting the eject portion and the engaging block from damage.

* * * * *